United States Patent [19]

Seifert

[11] 4,407,457

[45] Oct. 4, 1983

[54] FUEL INJECTION NOZZLE FOR INTERNAL COMBUSTION ENGINES

[75] Inventor: Kurt Seifert, Esslingen-Zollberg, Fed. Rep. of Germany

[73] Assignee: Robert Bosch GmbH, Stuttgart, Fed. Rep. of Germany

[21] Appl. No.: 326,091

[22] Filed: Nov. 30, 1981

[30] Foreign Application Priority Data

Dec. 20, 1980 [DE] Fed. Rep. of Germany ..... 3048304

[51] Int. Cl.[3] ..... F02M 61/00

[52] U.S. Cl. ..... 239/533.12

[58] Field of Search ..... 239/533.2–533.12, 239/453

[56] References Cited

U.S. PATENT DOCUMENTS 2,410,946 11/1946 Johnson ..... 239/533.12 X 3,446,440 5/1969 Pele et al. ..... 239/533.4 X

FOREIGN PATENT DOCUMENTS 1353436 5/1974 United Kingdom .

*Primary Examiner*—John J. Love

*Assistant Examiner*—Gene A. Church

*Attorney, Agent, or Firm*—Edwin E. Greigg

[57] ABSTRACT

A fuel injection nozzle for internal combustion engines is proposed in which a valve needle receives an auxiliary needle in a blind bore opening toward the side on which injection occurs, and in which two injection locations each having at least one injection opening are controllable in accordance with the stroke, and in which the valve needle controls the passage of fuel from a pressure chamber of the injection nozzle selectively to the injection areas. The auxiliary needle is urged in the opening direction of the valve needle by a spring and is displaced in the flow direction at a first, lower fuel pressure, whereby it hydraulically separates the two injection areas. At a second, higher pressure the auxiliary needle is carried along as a drag member by the valve needle so as to reestablish communication between the two injection areas.

7 Claims, 2 Drawing Figures

FUEL INJECTION NOZZLE FOR INTERNAL COMBUSTION ENGINES

BACKGROUND OF THE INVENTION

The invention is directed to a fuel injection nozzle having a valve needle and an auxiliary needle, the nozzle including two injection locations controlled in accordance with valve needle stroke. In a known fuel injection nozzle of this type exemplified by British Pat. No. 1,353,436 published May 15, 1974, the auxiliary needle acts solely as a drag needle to separate one injection location from the other during the first part of the valve needle stroke so that the fuel can be injected out of the pressure chamber via only one injection location. Upon the continuation of the opening stroke, the drag needle is then lifted from its seat, so that the second injection location also communicates with the pressure chamber for the purpose of injection. The opening sequence of the injection locations is thus controlled in accordance with the stroke. The disadvantage of the known nozzle is that, because of pressure waves in the fuel, the valve needle can begin to oscillate, which migh allow establishment of an undesirable communication between the second injection location and the pressure chamber even when the fuel injection quantities are small. This may unfavorably affect the course of combustion, particularly in terms of exhaust emissions. With this known fuel injection nozzle, the satisfactory attainment of a clearly-defined pressure step between a smaller injection quantity (idling and partial load) to be ejected via only one injection location and a larger quantity (full load) to be ejected via both injection locations is impossible.

OBJECT AND SUMMARY OF THE INVENTION

It is an object of the invention to provide a fuel injection nozzle having the advantage over the prior art that the injection of larger quantities via both injection locations is clearly distinguished, in terms of the opening pressure then required, from the injection of small quantities via only one injection location.

It is another object of the invention to provide that the auxiliary needle is under the force of a separate spring, so that the force of this spring can be selected substantially freely or designed in accordance with the desired control pressure.

The invention will be better understood and further objects and advantages thereof will become more apparent from the ensuing detailed description of preferred embodiments taken in conjunction with the drawings.

DESCRIPTION OF THE EXEMPLARY EMBODIMENTS

Figure 1:
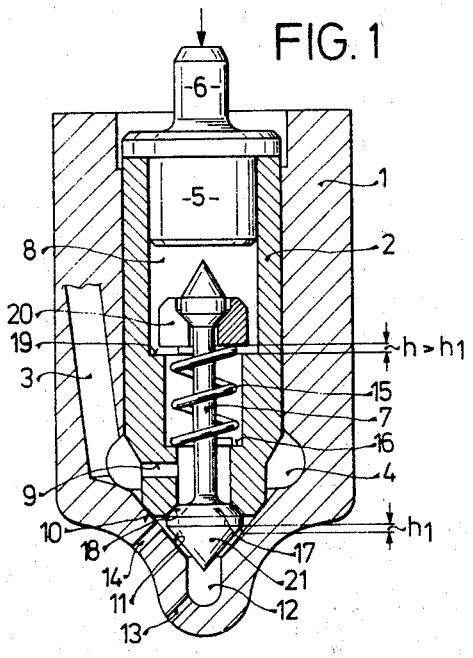
FIG. 1 is a cross-sectional view of a first exemplary embodiment of a fuel injection nozzle according to the invention, in which during low fuel pressure, the valve needle remains on its seat and only the auxiliary needle is actuated.
Figure 2:
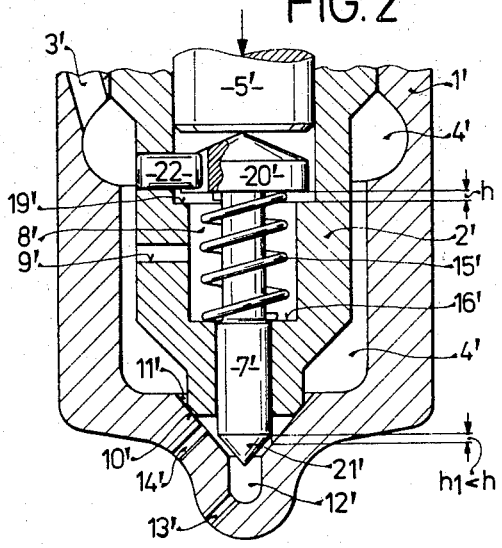
FIG. 2 is a cross-sectional view of a second exemplary embodiment, in which even at the low fuel pressure the valve needle does rise from its seat.

In both exemplary embodiments, that is, those shown in FIGS. 1 and 2 respectively, a valve needle 2 is guided within a nozzle body 1 such that the valve needle 2 is radially sealing and axially displaceable. Fuel is supplied to a pressure chamber 4 by the fuel injection pump (not shown) via a pressure line 3 extending within the nozzle body 1; this fuel pressure urges the valve needle 2 in the opening direction, counter to a closing force indicated by an arrow. Normally, a helical spring serves to supply the closing force. The valve needle 2 comprises a hollow needle. The end of the valve needle which is oriented toward the closing spring is sealed by a plug 5, on which a pressure pin 6 is disposed, in a known manner, as a support for a spring plate (not shown) on which the closing spring rests. An inner or auxiliary needle 7 reciprocates within a chamber in the hollow valve needle 2, at the extremity thereof which is remote from the plug 5. An interior chamber 8, defined by the hollow needle 2, the plug 5 and the inner needle 7, is in permanent communication with the pressure chamber 4 via a bore 9, so that the same pressure prevails in both the pressure chamber 4 and the interior chamber 8.

The valve needle 2 is provided with a sealing cone 10, which cooperates with a conical valve seat 11 of the nozzle body 1. This conical valve seat 11 merges with a blind bore 12 of the nozzle body 1, and at least one first injection opening 13 branches off from this blind bore 12. At least one second injection opening 14 branches off from the conical valve seat 11, downstream of the location on which the valve needle rests with its face 10 on the seat 11. The inner needle 7 also is provided with a sealing cone 21, which, in the illustrated position of rest inside the nozzle body 1, establishes communication between the first injection opening 13 and the second injection opening 14. This initial position of the inner needle 7 is determined by a spring 15, which is supported at one end on a shoulder 16 in the inner bore of the valve needle 2 and at the other end, at least indirectly, on the inner needle 7. The inner needle 7 is thus urged counter to the flow direction.

In the first exemplary embodiment shown in FIG. 1, the inner needle 7, in its position of rest, presses a cone 17 against a valve seat 18 on the valve needle 2; as a result, communication is established between the first injection opening 13 and the second injection opening 14 inside the nozzle body 1. Then as soon as fuel is supplied into the pressure chamber 4 via the pressure line 3 by the fuel injection pump (not shown), the pressure is extended into the interior chamber 8, so that fuel following after it lifts the inner needle 7 from the seat 18 and presses it against the seat 11. As a result, after a portion of the stroke designated as $h_1$ has been executed, the first injection opening 13 is separated from the second injection opening 14 and the interior chamber 8 is connected with the second injection opening 14, so that an injection takes place via this second injection opening 14. As soon as the quantity of fuel supplied per unit of time increases above a chosen level set by the closing spring tension, such as occurs at higher rpm or with a larger supply quantity, the valve needle 2 is also displaced counter to the closing spring and it lifts up from its valve seat 11. As a result, the pressure chamber 4 is connected directly with the injection opening 14. After a certain stroke h has been executed, the inner needle 7, as a drag member, is carried along by the valve needle 2; this occurs once a shoulder 19 in the interior chamber 8 has struck a spring support plate 20 engaging the spring 15 of the inner or auxiliary needle 7. As a result, the inner needle 7 is lifted once again from the seat 11, so that the pressure chamber is connected directly with the first injection opening 13 as well. For reasons having to with sealing and functional reliability and in order to set the instant at which the injection will occur via both openings 13 and 14, the distance h is always greater than $h_1$.

In the second exemplary embodiment shown in FIG. 2, all parts corresponding to the first exemplary embodiment have the same reference numerals but are supplied with a prime, in order to distinguish the two embodiments. In the second exemplary embodiment, the inner needle 7' is guided in a radially sealing manner within the valve needle 2' as in the first embodiment and the inner needle 7' in its initial position under the influence of the spring 15', connects the first injection opening 13' with the second injection opening 14' within the nozzle body 1'. As soon as the fuel proceeds from the injection pump into the pressure chamber 4', the inner needle 7' is first pressed against the seat 11' as the result of the extension of pressure via the bore 9' into the interior chamber 8'; this breaks the communication between the injection openings 13' and 14'. As the pressure increases further, the valve needle 2' then lifts from the seat 11', and the fuel, which is under pressure, proceeds out of the pressure chamber 4' to the second injection opening 14', through which it is then injected. Only at a still higher pressure, such as is caused by higher rpm or a larger fuel supply quantity, and upon the valve needle 2' executing the stroke h is the spring support plate 20' lifted and thereby the inner needle 7' lifted as well off the shoulder 19', so that the inner needle 7' lifts from the seat 11'. After the inner needle or auxiliary 7' has lifted, the pressure chamber 4' is connected with both injection openings 13' and 14', so that injection is effected via both openings. In order to assure high-quality sealing between the sealing cone 21' of the inner needle 7' and the seat 11', a sliding block 22 or some other position-fixing device is provided against the spring plate 21' to prevent twisting on the part of the inner needle 7'. In this second embodiment the stroke $h_1$ of the inner needle 7' is smaller than h, which distances against, as in the first exemplary embodiment, fix the instant of supplemented injection, i.e., the opening pressure at which injection will occur via both injection openings 13' and 14'.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines having a nozzle body, a valve needle in said nozzle body subjected to a closing force and arranged to open counter to fuel flow direction, said valve needle encompassing an auxiliary needle in an elongated chamber in said valve needle, said auxiliary needle extending from said chamber into a blind bore at a fuel injection end of said nozzle body, said nozzle body having fuel injection areas, each of said areas having at least one injection opening controllable in accordance with valve needle stroke, said valve needle arranged to control a passage from a pressure chamber of said injection nozzle to the injection areas, characterized in that said auxiliary needle is urged in an opening direction of said valve needle by a spring and is displaced in fuel flow direction at a first, lower fuel pressure whereby said injection areas are hydraulically separated from one another with fuel flow being interrupted to one of said areas, and further that said auxiliary needle is carried along as a drag member by said valve needle at a second, higher pressure and thereby reestablishes communication between said injection areas.

2. A fuel injection nozzle as defined by claim 1, characterized in that said elongated chamber serves as a work chamber for the auxiliary needle, receives the spring of the auxiliary needle, and is connected via a pressure-equalizing bore with the pressure chamber.

3. A fuel injection nozzle as defined by claim 2, characterized in that said elongated chamber comprises a stepped bore having a reduced diameter arranged to form a shoulder to support said spring.

4. A fuel injection nozzle as defined by claim 1, characterized in that said valve needle and said auxiliary needle each have a sealing cone portion and that each said sealing cone portions cooperate with a single valve seat cone in a nozzle body.

5. A fuel injection nozzle as defined by claim 1, characterized in that said auxiliary needle comprises a double-acting valve member which in its closed position separates said pressure chamber from said injection areas, while in a first working position, corresponding to a first pressure, said auxiliary needle reestablishes communication between said pressure chamber and one of said injection areas and in a second working position, corresponding to a second higher pressure said auxiliary needle connects said injection areas with one another and with said pressure chamber.

6. A fuel injection nozzle as defined by claim 1, characterized in that said auxiliary needle is guided in a substantially sealing manner in said elongated chamber within said valve needle, further wherein said auxiliary needle is displaced in a flow direction for a first pressure and positively displaces fuel through said fuel injection areas, said auxiliary needle arranged to separate said second area from said first area in order to connect said pressure chamber with one of said injection areas.

7. A fuel injection nozzle as defined by claim 6, characterized in that means supported by said valve needle prevents relative rotation of said auxiliary needle.

* * * * *